US008853138B1

(12) United States Patent
Lalla

(10) Patent No.: US 8,853,138 B1
(45) **Date of Patent: *Oct. 7, 2014**

(54) GEAR LUBRICANT COMPRISING CARBON BLACK

(71) Applicant: Etho Satish Lalla, Brisbane (AU)

(72) Inventor: Etho Satish Lalla, Brisbane (AU)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/291,363

(22) Filed: May 30, 2014

Related U.S. Application Data

(63) Continuation of application No. 13/273,425, filed on Oct. 14, 2011.

(51) Int. Cl.

| | |
|---|---|
| ***C10M 169/04*** | (2006.01) |
| ***C10M 111/04*** | (2006.01) |
| ***C10M 125/02*** | (2006.01) |
| ***C10M 113/02*** | (2006.01) |
| ***C10M 141/08*** | (2006.01) |
| *C10M 101/02* | (2006.01) |
| *C10M 143/06* | (2006.01) |
| *C10M 137/10* | (2006.01) |

(52) U.S. Cl.

CPC ..... *C10M 141/08* (2013.01); *C10M 2205/026* (2013.01); *C10M 125/02* (2013.01); *C10M 101/02* (2013.01); *C10M 2219/068* (2013.01); *C10M 143/06* (2013.01); *C10M 2203/1006* (2013.01); *C10M 2201/041* (2013.01); *C10M 137/10* (2013.01)

USPC ..... 508/113; 508/131

(58) Field of Classification Search

CPC ..... C10M 2203/1006; C10M 2201/041; C10M 2205/026

USPC ..... 508/113, 131

See application file for complete search history.

(56) References Cited

U.S. PATENT DOCUMENTS

| | | | | |
|---|---|---|---|---|
| 3,293,066 | A * | 12/1966 | Haines | 428/446 |
| 3,472,770 | A | 10/1969 | Preston et al. | |
| 5,190,682 | A | 3/1993 | Harris | |
| 6,251,839 | B1 | 6/2001 | Faci | |
| 6,809,208 | B2 | 10/2004 | Tinki et al. | |
| 7,615,522 | B2 | 11/2009 | Camenzind et al. | |
| 7,662,881 | B2 | 2/2010 | Walton et al. | |
| 8,349,774 | B2 | 1/2013 | Choi et al. | |
| 2007/0179066 | A1 | 8/2007 | Sakamoto et al. | |
| 2009/0275491 | A1 | 11/2009 | Komatsubara et al. | |

FOREIGN PATENT DOCUMENTS

| | | |
|---|---|---|
| CA | 1311463 | 12/1992 |
| CA | 2134798 | 11/1994 |
| EP | 0359466 | 3/1990 |
| EP | 1859012 | 4/2011 |

OTHER PUBLICATIONS

International Search Report and Written Opinion dated Jan. 31, 2013, issued in corresponding PCT application No. PCT/US2012/046349, 17 pages.

* cited by examiner

*Primary Examiner* — Vishal Vasisth

(74) *Attorney, Agent, or Firm* — Susan M. Abernathy; Melissa M. Hayworth; E. Joseph Gess

(57) ABSTRACT

A gear oil composition is provided. The composition comprises a major amount of base oil comprising a mixture of a mineral base oil and polybutene; and 0.1 to 0.5 wt % of carbon black, based on the total weight of the gear oil composition. Such compositions can provide improved viscosity stability.

16 Claims, No Drawings

GEAR LUBRICANT COMPRISING CARBON BLACK

This application is a continuation to an earlier patent application titled "GEAR LUBRICANT" (Publication No. US 2013-0096040 A1, application Ser. No. 13/273,425, filed on Oct. 14, 2011), herein incorporated in its entirety.

TECHNICAL FIELD

The application relates generally to compositions suitable for use as lubricants, particularly open gear lubricants.

BACKGROUND

Open gear lubricating oils and greases are used in machinery employing large, slow-moving gears under heavy load. As the name implies, the gears are open to the atmosphere. Open gear lubricants are subject to particularly severe operating conditions. Not only must the lubricant perform its basic function of minimizing friction and metal-to-metal contact between moving surfaces, but it must also be able operate over a wide temperature range and under high load conditions.

A basic requirement for an open gear lubricant is mechanical shear stability. Shear stability is a measure of the ability of an oil to resist permanent viscosity loss under high shear; the more shear stable an oil, the smaller the viscosity loss when subjected to shear. If the viscosity of the lubricant drops too much during operation, the gears will not be sufficiently lubricated and operators will not know when such a situation will occur. If the viscosity of the lubricant trends upward in a controlled manner during operation, operators will be able to notice the thickening through, e.g., channeling in the gear box and correct the situation with minimal adverse effects to the gears.

Highly adhesive lubricants are required for most open gear applications. Typically, such lubricants are heavy oils, asphalt-based compounds, or soft greases. As refiners turn from solvent refining to newer processes, the availability of heavy oils such as heavy cylinder stock is diminishing. High viscosity synthetic poly-alpha-olefins (PAOs) produced from $C_8$ to $C_{12}$ linear alpha-olefins are available. These PAOs have good shear stability but are expensive because of the high cost of the linear alpha-olefin raw material. High viscosity polyisobutylenes (PIBs) can also be used as a heavy oil alternative.

High viscosity base stocks can be blended with lower viscosity base stocks to increase viscosities of the low viscosity stocks. There is a need providing open gear lubricants with good shear stability without having to use highly expensive PAOs.

SUMMARY

In one aspect, we provide a gear oil composition comprising a major amount of a base oil comprising a mixture of a mineral base oil and polybutene; 0.1 to 0.5 wt % of carbon black, based on the total weight of the gear oil composition; and 0.001 to 30 wt % of at least one additive selected from dispersants, detergents, anti-foaming agents, antioxidants, rust inhibitors, metal passivators, extreme pressure agents, friction modifiers, and mixtures thereof, based on the total weight of the gear oil composition.

In another aspect, we provide a method for improving viscosity stability of a gear oil composition, comprising adding 0.1 to 0.5 wt % of carbon black, based on the total weight of the gear oil composition, to a major amount of base oil comprising a mixture of a mineral base oil and polybutene.

DETAILED DESCRIPTION

The following terms will be used throughout the specification and will have the following meanings unless otherwise indicated.

"Brookfield viscosity" is used to determine the low-shear-rate viscosity of lubricants, which can be measured by ASTM D2983-09 ("Standard Test Method for Low-Temperature Viscosity of Lubricants Measured by Brookfield Viscometer").

"Kinematic viscosity" is a measurement in $mm^2/s$ of the resistance to flow of a fluid under gravity, determined by ASTM D445-11a ("Standard Test Method for Kinematic Viscosity of Transparent and Opaque Liquids (and Calculation of Dynamic Viscosity)").

"Viscosity stability" refers to the ability to maintain a minimal change in Brookfield viscosity of a gear oil composition when subjected to ASTM D5182-97 (Reapproved 2008) ("Standard Test Method for Evaluating the Scuffing Load Capacity of Oils (FZG Visual Method)") with the modifications described herein. The change in the Brookfield viscosity of the gear oil composition is less than 5%, e.g., less than 2%.

Base Oil

The base oil suitable for use as a gear oil comprises a mixture of at least a mineral base stock and polybutene. In one embodiment, the base oil contains sufficient amounts of mineral and polybutene for the gear oil composition to have a kinematic viscosity at 100° C. of from 10 $mm^2/s$ to 15 $mm^2/s$. The composition comprises the base oil in a major amount; that is, an amount of greater than 50 wt %, (e.g., 60 wt %, 70 wt %, or 80 wt %), based on the total weight of the gear oil composition.

The mineral oil can be any of paraffinic and naphthenic oils, or mixtures thereof. Mineral oils can be obtained by subjecting a lubricating oil fraction produced by atmospheric- or vacuum-distilling a crude oil, to one or more refining processes such as solvent deasphalting, solvent extraction, hydrocracking, solvent dewaxing, catalytic dewaxing, hydrorefining, sulfuric acid treating, and clay treatment.

In one embodiment, the mineral oil can contain an amount of synthetic oils such as poly-α-olefins, ethylene/α-olefin copolymers, and ester-based synthetic oils, in an amount of 50 wt % or less, based on the total weight of the gear oil composition.

In one embodiment, the mineral oil (or blends of mineral oils and/or hydrocarbon-based synthetic oils) has a kinematic viscosity at 100° C. of from 3 to 120 $mm^2/s$ and a viscosity index of at least 60. In some embodiments, the mineral oil comprises less than 10 wt % (e.g., less than 5 wt %, less than 1 wt %, or less 0.5 wt %) of one or more heavy fractions. A heavy fraction refers to mineral oil fraction having a kinematic viscosity at 100° C. of at least 20 $mm^2/s$. In some embodiments, the heavy fraction has a kinematic viscosity at 100° C. of at least 25 $mm^2/s$ or 30 $mm^2/s$.

Polybutene

The polybutene processing oil is a low molecular weight ($M_n$<15,000) homopolymer or copolymer of olefin-derived units having from 3 to 8 carbon atoms, usually from 4 to 6 carbon atoms. The polybutene can be a homopolymer or copolymer of a $C_4$ raffinate. An embodiment of such low molecular weight polymers termed "polybutene" polymers (herein referred to as "polybutene processing oil" or "polybutene") is described, for example, by J. D. Fotheringham in

*Synthetic Lubricants and High-Performance Functional Fluids* (L. R. Rudnick and R. L. Shubkin, eds., Marcel Dekker 1999), 357-392.

In one embodiment, the polybutene processing oil is a copolymer of at least isobutylene derived units, 1-butene derived units, and 2-butene derived units. In one embodiment, the polybutene is a homopolymer, copolymer, or terpolymer of the three units, wherein the isobutylene derived units are from 40 to 100 wt % of the copolymer, the 1-butene derived units are from 0 to 40 wt % of the copolymer, and the 2-butene derived units are from 0 to 40 wt % of the copolymer. In another embodiment, the polybutene is a copolymer or terpolymer of the three units, wherein the isobutylene derived units are from 40 to 98 wt % of the copolymer, the 1-butene derived units are from 2 to 40 wt % of the copolymer, and the 2-butene derived units are from 0 to 30 wt % of the copolymer. In yet another embodiment, the polybutene is a terpolymer of the three units, wherein the isobutylene derived units are from 40 to 96 wt % of the copolymer, the 1-butene derived units are from 2 to 40 wt % of the copolymer, and the 2-butene derived units are from 2 to 20 wt % of the copolymer. In yet another embodiment, the polybutene is a homopolymer or copolymer of isobutylene and 1-butene, wherein the isobutylene derived units are from 65 to 100 wt % of the homopolymer or copolymer, and the 1-butene derived units are from 0 to 35 wt % of the copolymer.

Useful polybutene processing oils typically have a number average molecular weight ($M_n$) of less than 10,000 (e.g., less than 8000 or 6000). In some embodiments, the polybutene oil has a number average molecular weight of greater than 400 (e.g., greater than 700, 900, 1100, 1300, 1500, 1700, 1900, or 2100). For example, in some embodiments, the polybutene has a number average molecular weight of from 400 to 10,000 (e.g., from 700 to 8000, from 900 to 3000, or from 1100 to 2600).

Useful polybutene processing oils typically have a kinematic viscosity at 100° C. of from 10 to 6000 $mm^2/s$ (e.g., from 35 to 5000 $mm^2/s$). In some embodiments, the polybutene has a kinematic viscosity at 100° C. of at least 35 $mm^2/s$ (e.g., at least 200 $mm^2/s$, 600 $mm^2/s$, 800 $mm^2/s$, 2000 $mm^2/s$, or 2500 $mm^2/s$).

In one embodiment, the polybutene present in an amount of greater than 10 wt % (e.g., greater than 10 to 25 wt %, greater than 10 to 20 wt %, or greater than 10 to 15 wt %), based on the total weight of the gear oil composition.

Commercial examples of such a processing oil are Chevron Oronite PIB (San Ramon, Calif.); PARAPOL® processing oils (ExxonMobil Chemical Company, Houston, Tex.), such as PARAPOL™ 450, 700, 950, 1300, 2400 and 2500; DAELIM POLYBUTENE® (Daelim Industrial Co., Ltd., Korea) such as PB 1400, PB2000, and PB2400; INDOPOL® polybutene (INEOS Oligomers, League City, Tex.); and TPC PIB (Texas Petrochemicals, Houston, Tex.).

Carbon Black

The gear oil compositions disclosed herein comprise carbon black. Carbon black consists of black particles with a mean particle size of less than 500 nm obtained by momentarily (for a few milliseconds) heating crude hydrocarbons (oil, gas, etc.) at high temperature (e.g., 300° C. to 1800° C., or 800° C. to 1800° C.) for conversion to carbon. The mean particle size of the carbon black used is usually between 10 nm and 500 nm. As used herein, "mean particle size" refers to the mean diameter of the unit particles of the carbon black, and it is the average value of measurement with an electron microscope. Carbon black is available globally in commercial quantities. Current worldwide production is about 8.1 million metric tons per year.

Carbon black can be distinguished from graphite. For example, the crystal structure of graphite consists of hexagonal (or trigonal polygonal) flat sheets, whereas carbon black consists of unit particles of a type of amorphous carbon with fine crystals aggregated in a complex manner, and the fine crystals have a random layer structure with aggregation of several layers of aromatic planar molecules with average diameters of 2 nm to 3 nm. Carbon black also forms a structure with the unit particles linking together into chains, and acidic functional groups can be present on the surfaces of the particles.

The carbon black is present in an amount of from 0.1 to 0.5 wt % (e.g., 0.2 to 0.4 wt %), based on the total weight of the gear oil composition. If the carbon black content is below about 0.1 wt %, the effect of improving the shear stability of the composition by addition of the carbon black will tend to be inadequate. If the carbon black content is above about 0.5 wt %, the gear oil composition thickens too much resulting in an undesirable product. When graphite is used instead of carbon black, the gear oil composition thickens too much resulting in an undesirable product.

Additional Components

The gear oil composition comprises 0.001 to 30 wt % (based on the total weight of the gear oil composition) of one or more additives selected from dispersants, detergents, antifoaming agents, antioxidants, rust inhibitors, metal passivators, extreme pressure agents, friction modifiers, etc., in order to satisfy diversified characteristics, e.g., those related to friction, oxidation stability, cleanness and defoaming, etc.

Examples of dispersants include those based on polybutenyl succinic acid imide, polybutenyl succinic acid amide, benzylamine, succinic acid ester, succinic acid ester-amide and boron derivatives thereof. When used, ashless dispersants are typically employed in an amount of from 0.05 to 7 wt %, based on the total weight of the gear oil composition. In one embodiment, the dispersant is selected from the reaction product of a polyethylene polyamine (e.g., triethylene tetraamine or tetraethylene pentaamine) with a hydrocarbon-substituted anhydride made by the reaction of a polyolefin, having a molecular weight of 700 to 1400, with an unsaturated polycarboxylic acid or anhydride, e.g., maleic anhydride.

Examples of metallic detergents include those containing a sulfonate, phenate, salicylate of calcium, magnesium, barium or the like. When used, metallic detergents are usually incorporated in an amount of from 0.05 to 5 wt %, based on the total weight of the gear oil composition.

Defoaming agents can be optionally incorporated in an amount of from 10 to 100 ppm, based on the total weight of the gear oil composition. Examples of defoaming agents include but are not limited to dimethyl polysiloxane, polyacrylate and fluorine derivatives thereof, and perfluoropolyether.

Examples of antioxidants include but are not limited to amine-based antioxidants, e.g., alkylated diphenylamine, phenyl-α-naphthylamine and alkylated phenyl-α-naphthylamine; phenol-based antioxidants, e.g., 2,6-di-tert-butyl phenol, 4,4'-methylenebis-(2,6-di-tert-butyl phenol) and isooctyl-3-(3,5-di-tert-butyl-4-hydroxyphenyl)propionate; and sulfur-based antioxidants, e.g., dilauryl-3,3'-thiodipropionate; and zinc dithiophosphate. When used, antioxidants are incorporated in an amount from 0.05 to 5 wt %, based on the total weight of the gear oil composition.

Rust inhibitors can be used in an amount of from 0 to 30 wt %, based on the total weight of the gear oil composition. Examples include fatty acids, alkenylsuccinic acid half esters, fatty acid soaps, alkylsulfonates, polyhydric alcohol/fatty acid esters, fatty acid amines, oxidized paraffins and alkylpolyoxyethylene ethers.

Examples of metal passivators include thiazoles, triazoles, and thiadizoles. Specific examples of the thiazoles and thiadiazoles include 2-mercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis-(hydrocarbylthio)-1,3,4-thiadiazoles, and 2,5-bis-(hydrocarbyldithio)-1,3,4-thiadiazoles. Other suitable inhibitors of copper corrosion include imidazolines and the like. When used, metal passivators are incorporated in an amount of from 0.05 to 5 wt %, based on the total weight of the gear oil composition.

Anti-wear and/or extreme pressure agents can be incorporated in an amount of from 0.1 to 10 wt %, based on the total weight of the gear oil composition. Examples of anti-wear and/or extreme pressure agents include metal-free sulfur containing species including sulfurized olefins, dialkyl polysulfides, diarylpolysulfides, sulfurized fats and oils, sulfurized fatty acid esters, trithiones, sulfurized oligomers of $C_2$ to $C_8$ mono-olefins, thiophosphoric acid compounds, sulfurized terpenes, thiocarbamate compounds, thiocarbonate compounds, sulfoxides, thiol sulfinates, and the like. Other examples include metal-free phosphorus-containing anti-wear and/or extreme pressure additives such as esters of phosphorus acids, amine salts of phosphorus acids and phosphorus acid-esters, and partial and total thio analogs of the foregoing. In one embodiment, the composition comprises an acid phosphate as an anti-wear agent, with the agent having the formula $R^1O(R^2O)P(O)OH$, where $R^1$ is hydrogen or hydrocarbyl and $R^2$ is hydrocarbyl.

Friction modifiers can be incorporated in an amount of from 0.05 to 5 wt %, based on the total weight of the gear oil composition. Examples include but are not limited to organomolybdenum-based compounds, fatty acids, higher alcohols, fatty acid esters, sulfided esters, phosphoric acid esters, acid phosphoric acid esters, acid phosphorus acid esters and amine salts of phosphoric acid esters.

Small amounts of traction reducers can be incorporated in the gear oil composition, e.g., from 0.5 to 10 wt % (based on the total weight of the gear oil composition). Examples of traction reducers include ExxonMobil's Norpar™ fluids (comprising normal paraffins), Isopar™ fluids (comprising isoparaffins), Exxsol™ fluids (comprising dearomatized hydrocarbon fluids), Varsol™ fluids (comprising aliphatic hydrocarbon fluids), and mixtures thereof.

Pour point depressants can be incorporated in an amount of from 0.05 to 10 wt %, based on the total weight of the gear oil composition. Examples include, but are not limited to, ethylene/vinyl acetate copolymers, condensates of chlorinated paraffin and naphthalene, condensates of chlorinated paraffin and phenol, polymethacrylates, polyalkyl styrenes, chlorinated wax-naphthalene condensates, vinyl acetate-fumarate ester copolymers, and the like.

The composition can further include at least one of a polyoxyalkylene glycol, polyoxyalkylene glycol ether, and an ester as a solubilizing agent in an amount of from 10 to 25 wt %, based on the total weight of the gear oil composition. Examples include esters of a dibasic acid (e.g., phthalic, succinic, alkylsuccinic, alkenylsuccinic, maleic, azelaic, suberic, sebacic, fumaric or adipic acid, or linolic acid dimmer) and alcohol (e.g., butyl, hexyl, 2-ethylhexyl, dodecyl alcohol, ethylene glycol, diethylene glycol monoether or propylene glycol); and esters of a monocarboxylic acid of 5 to 18 carbon atoms and polyol (e.g., neopentyl glycol, trimethylolpropane, pentaerythritol, dipentaerythritol or tripentaerythritol); polyoxyalkylene glycol esters; and phosphate esters.

The composition can further comprise at least a viscosity modifier in an amount of from 0.5 to 10 wt %, based on the total weight of the gear oil composition. Examples of viscosity modifiers include but are not limited to the group of polymethacrylate type polymers, ethylene-propylene copolymers, styrene-isoprene copolymers, hydrated styrene-isoprene copolymers, and mixtures thereof. In one embodiment, the viscosity modifier is a blend of a polymethacrylate having a weight average molecular weight of 25,000 to 150,000 and a shear stability index less of than 5 and a polymethacrylate having a weight average molecular weight of 500,000 to 1,000,000 and a shear stability index of 25 to 60.

Solid materials such as finely divided molybdenum disulfide, talc, metal powders, and various polymers such as polyethylene wax can also be added to the gear oil composition to impart special properties.

Methods for Making

Additives used in formulating the gear oil composition can be blended into base oil blends individually or in various sub-combinations. In one embodiment, all of the components are blended concurrently using an additive concentrate (i.e., additives plus a diluent, such as a hydrocarbon solvent). The use of an additive concentrate takes advantage of the mutual compatibility afforded by the combination of ingredients when in the form of an additive concentrate. In another embodiment, the composition is prepared by mixing the base oil and the additive(s) at an appropriate temperature (e.g., 60° C.) until homogeneous.

EXAMPLES

The following examples are given to illustrate the present invention. It should be understood, however, that the invention is not to be limited to the specific conditions or details described in these examples.

Several gear oils were evaluated for shear stability before and after the FZG Scuffing Test. The lubricants were formulated with a conventional additive package suitable for use in open gear applications. The Brookfield viscosity of each oil was measured before and after running the FZG Scuffing Test. The FZG Scuffing Test is used to measure the scuffing load capacity of oils used to lubricate hardened steel gears. This test was performed according to ASTM D5182-97 (Reapproved 2008) with the following modifications: the Test Load was Stage 10, the gear speed was 1000 rpm on the drive side, and the test gear box was continuously cooled with water to control the operating temperature. The results are set forth in Table 1.

TABLE 1

| | Oil 1 | Oil 2 |
|---|---|---|
| Component, wt % | | |
| Mineral Base Oil | 77.80 | 77.68 |
| 2400 MW Polybutene | 10.32 | 10.32 |
| Carbon black | 0.08 | 0.20 |
| Additive package comprising a mixure of metal dialkyldithiocarbamates | 3.32 | 3.32 |
| Properties | | |
| Brookfield Viscosity @ 25° C. Before FZG Test, cP | 1850 | 2055 |
| Brookfield Viscosity @ 25° C. After FZG Test, cP | 1750 (107 h) | 2080 (145 h) |
| Change in Brookfield Viscosity @ 25° C., % | −5.4 | +1.2 |

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

Unless otherwise specified, the recitation of a genus of elements, materials or other components, from which an individual component or mixture of components can be selected, is intended to include all possible sub-generic combinations of the listed components and mixtures thereof This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A gear oil composition, comprising:

a. a major amount of a mineral oil having an oil kinematic viscosity at 100° C. from 3 to 120 $mm^2/s$ and a viscosity index of at least 60, wherein the mineral oil comprises less than 5 wt % of a heavy fraction;

b. a polybutene in an amount from greater than 10 wt % to 25 wt %, based on a total weight of the gear oil composition;

c. 0.1 to 0.5 wt % of carbon black, based on the total weight of the gear oil composition, wherein the carbon black consists of unit particles of amorphous carbon with the unit particles linking together into chains;

d. 0.001 to 30 wt % of at least one additive selected from dispersants, detergents, antifoaming agents, antioxidants, rust inhibitors, metal passivators, extreme pressure agents, friction modifiers, and mixtures thereof, based on the total weight of the gear oil composition.

2. The gear oil composition of claim 1, wherein the polybutene has a number average molecular weight of from 400 to 10,000.

3. The gear oil composition of claim 1, wherein the polybutene has a kinematic viscosity at 100° C. of from 35 to 5000 $mm^2/s$.

4. The gear oil composition of claim 1, wherein the carbon black has a mean particle size of less than 500 nm.

5. The gear oil composition of claim 1, wherein the carbon black is 0.2 to 0.4 wt %, based on the total weight of the gear oil composition.

6. The gear oil composition of claim 1, wherein the gear oil composition maintains a minimal change in a Brookfield viscosity by ASTM D2983-09 when subjected to an FZG Scuffing Test.

7. The gear oil composition of claim 6, wherein a change in the Brookfield viscosity by ASTM D2083-09 of the gear oil composition when subjected to a modified FZG Scuffing Test by ASTM D5182-97 (Reapproved 2008) is less than 5%; wherein the modified FZG Scuffing Test is modified by having: a Test Load of Stage 10, a gear speed of 1000 rpm on a drive side, and a test gear box continuously cooled with water to control an operating temperature.

8. The gear oil composition of claim 7, wherein the change in the Brookfield viscosity is less than 2%.

9. A method for improving viscosity stability of a gear oil composition, comprising adding 0.1 to 0.5 wt % of a carbon black, based on a total weight of the gear oil composition, to a major amount of a mixture of a mineral base oil and a polybutene;

wherein the mineral base oil has an oil kinematic viscosity at 100° C. from 3 to 120 $mm^2/s$ and a viscosity index of at least 60, and wherein the mineral base oil comprises less than 5 wt % of a heavy fraction;

wherein the polybutene has a number average molecular weight of from 400 to 10,000; and wherein the carbon black consists of unit particles of amorphous carbon with the unit particles linking together into chains.

10. The method of claim 9, wherein the polybutene is present in an amount from greater than 10 wt % to 25 wt %, based on the total weight of the gear oil composition.

11. The method of claim 9, wherein the polybutene has a kinematic viscosity at 100° C. of from 35 to 5000 $mm^2/s$.

12. The method of claim 9, wherein the carbon black has an average particle size of less than 500 nm.

13. The method of claim 9, wherein the carbon black is present in an amount of from 0.2 to 0.4 wt %, based on the total weight of the gear oil composition.

14. The method of claim 9, wherein the gear oil composition maintains a minimal change in a Brookfield viscosity by ASTM D2983-09 when subjected to an FZG Scuffing Test.

15. The method of claim 14, wherein a change in the Brookfield viscosity of the gear oil composition when subjected to a modified FZG Scuffing Test by ASTM D5182-97 (Reapproved 2008) is less than 5%; wherein the modified FZG Scuffing Test is modified by having: a Test Load of Stage 10, a gear speed of 1000 rpm on a drive side, and a test gear box continuously cooled with water to control an operating temperature.

16. The method of claim 15, wherein the change in the Brookfield viscosity is less than 2%.

* * * * *